US011714446B1

(12) United States Patent
Yue

(10) Patent No.: US 11,714,446 B1
(45) Date of Patent: Aug. 1, 2023

(54) LOW NOISE BANDGAP CIRCUIT

(71) Applicant: Gigajot Technology, Inc., Pasadena, CA (US)

(72) Inventor: Xin Yue, Monrovia, CA (US)

(73) Assignee: Gigajot Technology, Inc., Glendale, CA (US)

( * ) Notice: Subject to any disclaimer, the term of this patent is extended or adjusted under 35 U.S.C. 154(b) by 0 days.

(21) Appl. No.: 17/470,329

(22) Filed: Sep. 9, 2021

Related U.S. Application Data

(60) Provisional application No. 63/076,989, filed on Sep. 11, 2020.

(51) Int. Cl.
*G05F 3/30* (2006.01)
*G05F 1/567* (2006.01)

(52) U.S. Cl.
CPC ..... *G05F 3/30* (2013.01); *G05F 1/567* (2013.01)

(58) Field of Classification Search
None
See application file for complete search history.

(56) References Cited

U.S. PATENT DOCUMENTS

| | | | | |
|---|---|---|---|---|
| 7,161,340 | B2 * | 1/2007 | Chiu | G05F 3/30 323/907 |
| 7,531,998 | B2 * | 5/2009 | Kim | G05F 3/30 323/907 |
| 7,863,882 | B2 | 1/2011 | Harvey | |
| 8,421,433 | B2 | 4/2013 | Vyne | |
| 8,508,211 | B1 | 8/2013 | Anderson | |
| 9,285,820 | B2 | 3/2016 | Kalb et al. | |
| 10,228,715 | B2 * | 3/2019 | Segarra | G05F 3/30 |
| 10,673,415 | B2 | 6/2020 | Gupta et al. | |
| 10,958,227 | B2 * | 3/2021 | Wan | H03F 1/303 |
| 2006/0125547 | A1 * | 6/2006 | Maymandi-Nejad | G05F 3/262 327/512 |
| 2008/0061864 | A1 * | 3/2008 | Oberhuber | G05F 3/30 327/512 |
| 2010/0244808 | A1 * | 9/2010 | Marinca | G05F 3/30 323/315 |
| 2013/0038317 | A1 | 2/2013 | Marinca | |
| 2017/0023416 | A1 * | 1/2017 | Kim | G01K 7/01 |
| 2020/0103289 | A1 * | 4/2020 | Horng | G01K 7/01 |
| 2022/0075405 | A1 * | 3/2022 | Marinca | G05F 3/30 |

* cited by examiner

*Primary Examiner* — Thomas J. Hiltunen
(74) *Attorney, Agent, or Firm* — Robert C. Kowert; Kowert, Hood, Munyon, Rankin & Goetzel, P.C.

(57) ABSTRACT

Multiple temperature-proportional cores are implemented within a bandgap circuit to deliver respective, uncorrelated temperature-proportional currents to a temperature-complementary load, reducing flicker noise in the resulting bandgap reference voltage.

20 Claims, 2 Drawing Sheets

LOW NOISE BANDGAP CIRCUIT

CROSS-REFERENCE TO RELATED APPLICATIONS

Figure 1:
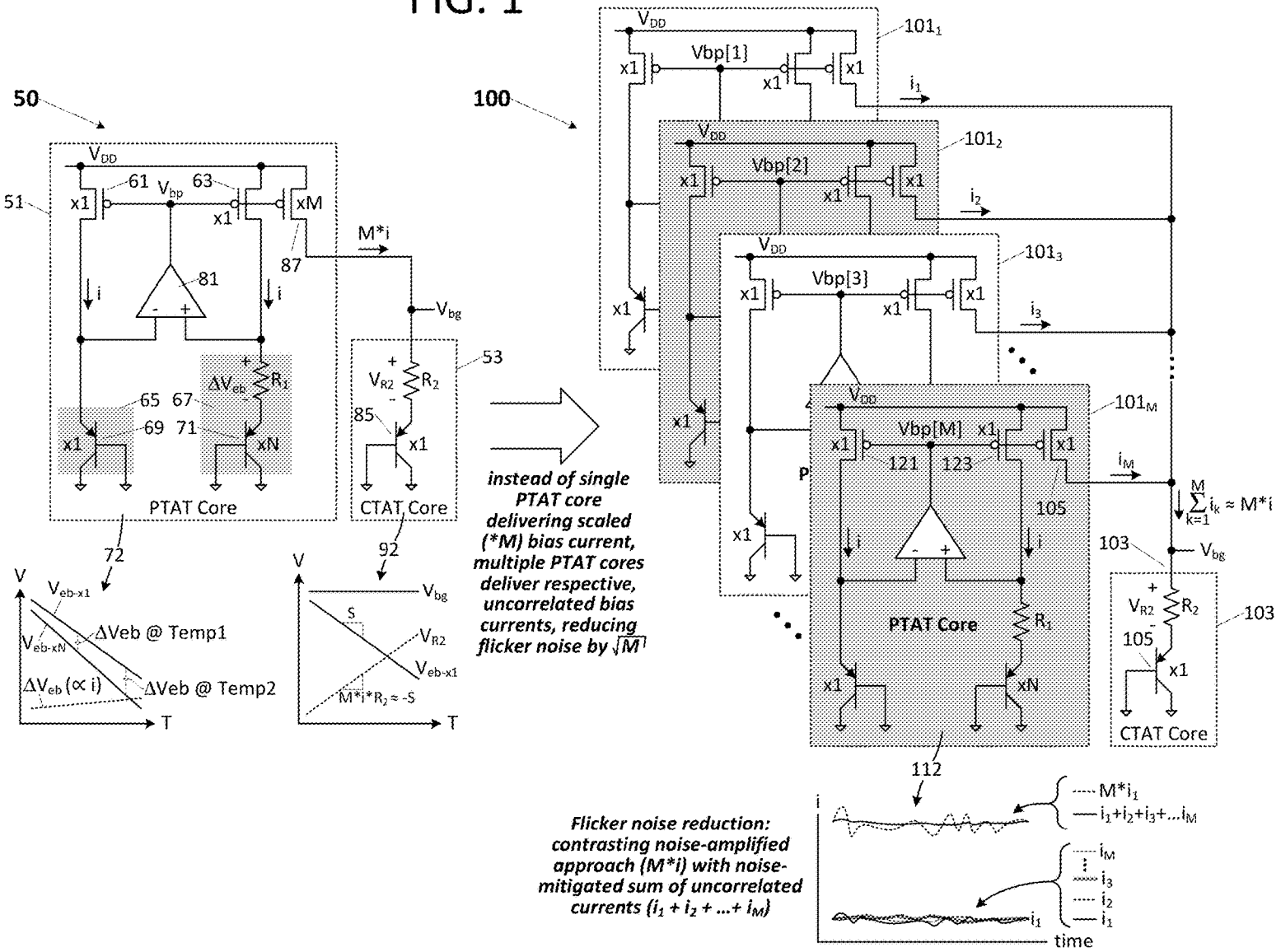

This application hereby claims priority to and incorporates by reference U.S. provisional application No. 63/076,989 filed Sep. 11, 2020.

DRAWINGS

Figure 2:
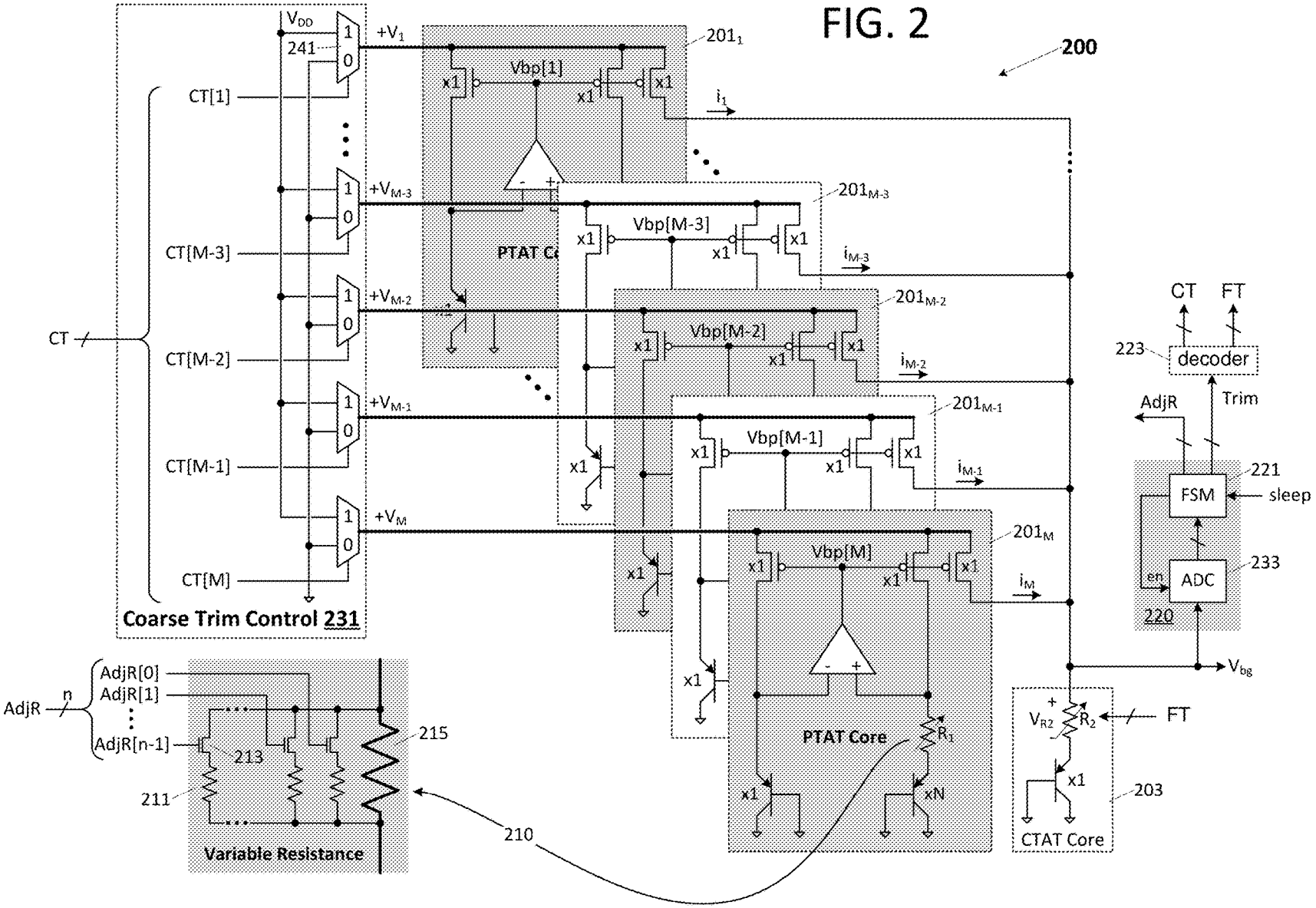

The various embodiments disclosed herein are illustrated by way of example, and not by way of limitation, in the figures of the accompanying drawings and in which like reference numerals refer to similar elements and in which:

FIG. 1 contrasts operation and implementation of a bandgap circuit having a single proportional-to-absolute-temperature (PTAT) core with a low-noise multi-core bandgap circuit having multiple uncorrelated PTAT cores; and FIG. 2 illustrates an embodiment of a low-noise multi-PTAT-core bandgap circuit having circuitry to equalize steady-state (DC) offsets between the uncorrelated current outputs of respective PTAT cores, enable coarse/fine calibration of the bandgap output voltage, and/or provide for bandgap circuit power down during reduced-power operation of an integrated circuit component or device in which the multi-PTAT-core bandgap circuit is deployed.

DETAILED DESCRIPTION

A bandgap circuit having multiple temperature-proportional cores that deliver respective, uncorrelated temperature-proportional currents to a temperature-complementary load is disclosed in various embodiments herein. In a number of implementations, the quantity of temperature-proportional (proportional-to-absolute-temperature or "PTAT") cores is chosen to yield a sum of uncorrelated temperature-proportional currents having a positive temperature coefficient that matches, with opposite sign, the negative temperature coefficient of the temperature-complementary (complementary-to-absolute-temperature or "CTAT") load or core. In other embodiments, the currents output from one or more of the PTAT cores may be scaled/multiplied to reduce the number of PTAT cores needed to yield the desired temperature coefficient. In all embodiments, calibration operations may be executed (and adjustment/control circuitry provided) to equalize amplitudes of the currents output by respective PTAT cores and/or align magnitudes of positive and negative temperature coefficients as necessary to render a temperature-insensitive (temperature-independent) bandgap output voltage.

FIG. 1 contrasts operation and implementation of a bandgap circuit 50 having a single PTAT core 51 with a low-noise multi-core bandgap circuit having multiple uncorrelated PTAT cores $\mathbf{101}_1$-$\mathbf{101}_M$. As shown, the single PTAT core within bandgap circuit 50 delivers a mirror-scaled bias current to a CTAT core 53—internal PTAT current 'i' multiplied by scaling factor 'M'—while the multiple PTAT cores $\mathbf{101}_1$-$\mathbf{101}_M$ within multi-core embodiment 100 produce respective uncorrelated temperature-proportional currents ($i_1, i_2, i_3, \ldots, i_M$) that are wire-summed to deliver an aggregate, noise-mitigated bias current to a CTAT core 103.

Referring first to the single PTAT core 51 within bandgap circuit 50, a current mirror implemented by PMOS (P-type complementary metal oxide semiconductor) transistors 61 and 63 yields matching PTAT-internal currents 'i' to respective loads 65 and 67, the first constituted by a diode-configured PNP bipolar-junction transistor (BJT) 69 having a unit size (x1) and the latter (load 67) formed by a size-scaled PNP BJT 71 (i.e., having size "xN" and thus having a junction area N times larger than x1 BJT 69) in series with a resistive element, $R_1$. Referring to the conceptual voltage versus temperature graph at 72, when the emitter-to-base (PN) junction of either BJT (69 or 71) is forward biased, the emitter-to-base voltage $V_{eb}$ of the BJT is characterized by a negative temperature coefficient (i.e., $V_{eb}$ drops as temperature rises). As the emitter-to-base voltage for the larger xN BJT ($V_{eb\text{-}xN}$) falls more rapidly with temperature than for the smaller x1 BJT ($V_{eb\text{-}x1}$), the difference between the emitter-to-base voltages of the two BJTs (i.e., $\Delta V_{eb}=V_{eb\text{-}x1}-V_{eb\text{-}xN}$) increases with rising temperature (i.e., $\Delta V_{eb}$ has a positive temperature coefficient) and, owing to the virtual short between the inverting and non-inverting inputs of operational amplifier 81, appears across resistive element $R_1$. More specifically, operational amplifier 81 adjusts the bias voltage ($V_{bp}$) applied to the gates of PMOS transistors 61 and 63 to yield a PTAT-internal current 'i' that, by virtue of negative feedback, drives the voltage at the non-inverting input of the operational amplifier (i.e., $iR_1+V_{eb\text{-}xN}$) to match that at the inverting op-amp input ($V_{eb\text{-}x1}$), so that $i=(V_{eb\text{-}x1}-V_{eb\text{-}xN})/R_1=\Delta V_{eb}/R_1$ and thus constitutes a PTAT-internal current that rises and falls (like $\Delta V_{eb}$) in proportion to rising and falling temperature, respectively—a proportionality shown in graph 72.

Still referring to the single-PTAT-core bandgap circuit implementation at 50, the positive temperature coefficient of the PTAT-internal current (i.e., positive slope; rising in proportion to $\Delta V_{eb}$ and thus in proportion to rising temperature) has a magnitude substantially lower—by a nominal factor of 'M'—than the magnitude of the negative temperature coefficient of the x1 BJT, a component replicated within the CTAT core (i.e., at 85). Accordingly, by scaling/multiplying the PTAT-internal current by M—a multiplication achieved by enlarging output-drive transistor 87 by a factor of M relative to internal-current-drive transistors 61 and 63 (with gates of all three transistors being coupled to the output of amplifier 81 and thus mirrored)—to yield scaled output current M*i (i.e., via transistor 87) and delivering that scaled output current to CTAT BJT 85 via resistor $R_2$, any temperature-change-driven decrease or increase in the emitter-to-base voltage of BJT 85 (i.e., $V_{eb\text{-}x1}$) will be counteracted by matching increase or decrease, respectively, in the voltage drop across $R_2$, thereby yielding a temperature-insensitive ("temperature-flat") bandgap output voltage, $V_{bg}$—all as shown conceptually in the voltage-vs-temperature graph at 92.

As with virtually all electronic circuits, PTAT core 51 is afflicted by flicker noise (or 1/f noise or pink noise)—a relatively low frequency noise (and thus difficult to spectrally filter, particularly in MOS circuits) that appears in the PTAT-internal current and is thus multiplied/amplified by the xM current-scaling PMOS transistor 87. The multiple PTAT cores $\mathbf{101}_1$-$\mathbf{101}_M$ in bandgap circuit embodiment 100 avoid this undesirable noise amplification by delivering respective, uncorrelated currents to CTAT core 103—currents that, at least in the FIG. 1 embodiment, are unscaled (i.e., each of currents $i_1, i_2, i_3, \ldots, i_M$ matches the corresponding PTAT-internal current 'i' within the corresponding PTAT core) so that their wire sum (all uncorrelated currents being delivered to the same CTAT core input node 104) constitutes an aggregate PTAT current that nominally matches the desired M*i current amplitude ('*' denoting multiplication) required to cancel temperature-drift-induced changes in the voltage across BJT 105.

In the FIG. 1 embodiment, each of the PTAT cores $\mathbf{101}_1$-$\mathbf{101}_M$ (collectively/generically, "101") is identically implemented and operates as discussed above with respect to PTAT core 51, except having a unity (x1) output-drive transistor 107 instead of xM scaling transistor 87—that is, each of the PTAT cores 101 outputs a mirrored (x1) instance of its PTAT-internal current, uncorrelated to the currents output by the other PTAT cores. Accordingly, as shown at 112, flicker noise within the aggregate current (sum of x1 currents from the PTAT cores 101) is reduced by $M^{1/2}$ (square root of M) relative the xM scaled current in single-core bandgap circuit implementation 50, with corresponding noise reduction in the multi-core bandgap output voltage, $V_{bg}$.

While low-noise multicore bandgap circuit 100 includes a number (quantity) of PTAT cores 101 according to the scaling factor M required to equalize temperature-coefficient magnitudes of the aggregate PTAT current and $V_{eb\text{-}x1}$ (i.e., voltage across BJT 105), fewer or more than 'M' PTAT cores may contribute to the aggregate PTAT current in alternative embodiments. For example, in a system having an approximate coefficient-equalization factor of eight (i.e., M=8), four PTAT cores 101 may each contribute a x2 current (i.e., output-drive PMOS transistor 105 implemented with twice the width/length ratio of x1 PMOS transistors 121 and 123). Conversely, in a application having an approximate coefficient-equalization factor of four (M=4), sixteen PTAT cores 101 may each contribute a x0.5 current (output drive transistor 105 half the size of transistors 121 and 123), thereby reducing flicker noise in the aggregate current by a factor of four ($16^{1/2}$). Nor must all PTAT cores contribute matched currents—for instance, five PTAT cores 101 with respective x1 current contributions may be supplemented by a sixth PTAT core with x0.5 current contribution to yield a coefficient-equalization factor of 5.5.

FIG. 2 illustrates an embodiment of a low-noise multi-PTAT-core bandgap circuit 200 having circuitry to equalize steady-state (DC) offsets between the uncorrelated current outputs of respective PTAT cores, enable coarse/fine calibration of (i.e., trim or adjust) the bandgap output voltage, and/or provide for bandgap circuit power down during reduced-power operation (e.g., sleep mode) of a host integrated circuit component or device. The multiple PTAT cores ($\mathbf{201}_1$-$\mathbf{201}_M$; collectively/generically 201) and CTAT core 203 are implemented and operate generally as discussed in reference to FIG. 1, but with adjustable-resistance implementations of resistive elements $R_1$ to enable per-core output current adjustment (and thus nominal alignment/equalization of the currents from all PTAT cores) and/or an adjustable implementation of CTAT resistive element $R_2$ to enable fine-trim adjustment of temperature-proportional voltage drop $V_{R2}$ (and thus equalization of the magnitudes of the positive and negative temperature coefficients within the bandgap circuit as necessary to generate temperature-insensitive output voltage, $V_{bg}$). Both or any of those variable-resistance elements (the multiple instances of $R_1$ within respective PTAT cores 201 and/or $R_2$ within the CTAT core 203) may be implemented as shown at 210, having resistive elements 211 (which may be binary weighted, thermometer-coded, etc.) that may be selectively coupled in parallel (via transistors 213) with a baseline max-resistance 215 in response to a digital resistance-adjust value (AdjR) to enable a range of resistances from maximum (all transistors 211 off) to minimum (all transistors 211 on). In alternative embodiments, the variable resistance may instead be implemented by resistive elements switchably added in series with a baseline-minimum resistance (i.e., resistance 215 coupled in series with multiple resistances 211—again binary weighted, thermometer coded, etc. —with transistor bypass option for each additional resistive element; or a combination of serial and parallel switched resistive elements. In any case, the resistance of variable PTAT resistors $R_1$ may be reduced or increased to effect a corresponding increase or decrease in the current contributed by the host PTAT core. Similarly, all resistances $R_1$ (i.e., within each of PTAT cores $\mathbf{201}_1$-$\mathbf{201}_M$) may be raised or lowered together to effect fine-grained (relatively high resolution) adjustment of the aggregate PTAT current (i.e., sum of respective currents from PTAT cores 201)

In one embodiment, a finite state machine 221—or processor, sequencer or other control circuitry within a calibration engine 220 co-located with bandgap circuit 200 in a host integrated circuit (IC) or implemented in a separate IC—executes a calibration operation to equalize the current contributions of respective PTAT cores 201. For example, the FSM may power the individual PTAT cores one at a time (e.g., by outputting a sequence of trim values to selectively enable, via optional decoder 223 and coarse trim control circuit 231, supply-voltage delivery (i.e., V+[1], . . . V+[M−1], V+[M]) to a given PTAT core 201 while the supply lines to all other PTAT cores is switched to ground), triggering digitization of the bandgap voltage (e.g., potential difference between $V_{bg}$ and a bandgap-independent voltage reference such as $V_{DD}$ or $V_{DD}/2$) produced by each individual PTAT current contribution within analog-to-digital converter (ADC) 233, and then iteratively adjusting the $R_1$ resistance of individual cores as necessary to align all the current contributions of all PTAT cores 201. In such an embodiment, FSM outputs a respective AdjR value for each PTAT core 201 (i.e., to allow independent adjustment of resistances $R_1$)—values that may be adjusted in lock-step up or down to effect the aforementioned adjustment of aggregate PTAT current. In other embodiments, resistive values of one or more individual resistors $R_1$ may be adjusted up or down to effect high-precision step-up or step-down of the aggregate PTAT current and thus corresponding high-precision adjustment of the positive temperature coefficient (i.e., temperature dependence of $V_{R2}$)—that is, intentionally adjusting output currents of one or more PTAT cores irrespective of core-to-core output current alignment. In yet other embodiments, FSM 221 may output a single $R_1$-adjust value (AdjR) to all PTAT cores 201 so that respective currents from all PTAT cores are raised and lowered in lock step.

Still referring to FIG. 1, FSM 221 (or other control circuit) may additionally adjust the number (quantity) of PTAT cores 201 contributing to the aggregate PTAT current (e.g., adjusting most-significant bits of a "trim" value supplied to optional decoder 223 and thus asserting a selectable number of PTAT-enabling "coarse-trim" signals "CT" within coarse trim control circuit 231)—that is selectively switching off one or more PTAT cores by coupling the voltage supply line thereof to either VDD or ground via a corresponding one of multiplexers 241)—and thereby effect a coarse adjustment of the relative magnitudes of the positive and negative temperature coefficients (i.e., changing the magnitude of the aggregate PTAT current vs. negative temperature coefficient of the BJT within CTAT core 203). FSM 221 may further adjust the value of resistance $R_2$ (e.g., via a variable-resistance circuit similar to that shown at 210 and described above, with resistance-adjust bit supplied by the least-significant fine-trim (FT) bits of the trim value output from FSM 221 and optionally decoded within decoder 223) to effect relatively fine (higher resolution) change in the positive temperature coefficient. As discussed above, FSM 221 may similarly raise or lower the values of respective resistances $R_1$ (within respective PTAT cores) to effect a high-resolution change in the positive temperature coefficient—adding to the fine-resolution range where resistances $R_1$ and resistance $R_2$ are both adjustable or effecting the fine-resolution adjustment where $R_2$ is fixed. In one embodiment, FSM 221 carries out the temperature-coefficient trimming during production time configuration, measuring $V_{bg}$ (e.g., triggering operation of ADC 223 through assertion of enable signal "en") over a range of temperatures (e.g., as the host IC is cycled through an operating temperature range within a test oven or other temperature-controlled environment), iteratively adjusting (trimming) the positive temperature coefficient to yield a temperature-flat/temperature-insensitive band gap output voltage. Also, during power-down or sleep modes (e.g., signaled by "sleep" signal 246 or other power control signal), FSM 221 may disable all PTAT cores 201 by zeroing the coarse control value (e.g., setting CT[M:1]=00 . . . 0b and thereby grounding the supply power rails of PTAT cores 201 via multiplexers 241) to cut bandgap-circuit power consumption to zero or near-zero.

The various multi-PTAT-core bandgap circuits and related calibration, power control and trimming circuitry, operating methods thereof etc. disclosed herein may be described using computer aided design tools and expressed (or represented), as data and/or instructions embodied in various computer-readable media, in terms of their behavioral, register transfer, logic component, transistor, layout geometries, and/or other characteristics. Formats of files and other objects in which such circuit, layout, and architectural expressions may be implemented include, but are not limited to, formats supporting behavioral languages such as C, Verilog, and VHDL, formats supporting register level description languages like RTL, and formats supporting geometry description languages such as GDSII, GDSIII, GDSIV, CIF, MEBES and any other suitable formats and languages. Computer-readable media in which such formatted data and/or instructions may be embodied include, but are not limited to, computer storage media in various forms (e.g., optical, magnetic or semiconductor storage media, whether independently distributed in that manner, or stored "in situ" in an operating system).

When received within a computer system via one or more computer-readable media, such data and/or instruction-based expressions of the above described circuits and device architectures can be processed by a processing entity (e.g., one or more processors) within the computer system in conjunction with execution of one or more other computer programs including, without limitation, net-list generation programs, place and route programs and the like, to generate a representation or image of a physical manifestation of such circuits and architectures. Such representation or image can thereafter be used in device fabrication, for example, by enabling generation of one or more masks that are used to form various components of the circuits in a device fabrication process.

In the foregoing description and in the accompanying drawings, specific terminology and drawing symbols have been set forth to provide a thorough understanding of the disclosed embodiments. In some instances, the terminology and symbols may imply details not required to practice those embodiments. For example, any of the specific quantities/types of PTAT cores, signal polarities, transistor types (PMOS vs. NMOS), calibration techniques, and the like can be different from those described above in alternative embodiments. Signal paths depicted or described as individual signal lines may instead be implemented by multi-conductor signal buses and vice-versa and may include multiple conductors per conveyed signal (e.g., differential or pseudo-differential signaling). The term "coupled" is used herein to express a direct connection as well as a connection through one or more intervening functional components or structures. Programming of operational parameters (calibration value storage, etc.) or any other configurable parameters may be achieved, for example and without limitation, by loading a control value into a register or other storage circuit within above-described integrated circuit devices in response to a host instruction and/or on-board processor or controller (and thus controlling an operational aspect of the device and/or establishing a device configuration) or through a one-time programming operation (e.g., blowing fuses within a configuration circuit during device production), and/or connecting one or more selected pins or other contact structures of the device to reference voltage lines (also referred to as strapping) to establish a particular device configuration or operation aspect of the device. The terms "exemplary" and "embodiment" are used to express an example, not a preference or requirement. Also, the terms "may" and "can" are used interchangeably to denote optional (permissible) subject matter. The absence of either term should not be construed as meaning that a given feature or technique is required.

Various modifications and changes can be made to the embodiments presented herein without departing from the broader spirit and scope of the disclosure. For example, features or aspects of any of the embodiments can be applied in combination with any other of the embodiments or in place of counterpart features or aspects thereof. Accordingly, the specification and drawings are to be regarded in an illustrative rather than a restrictive sense.

What is claimed is:

1. An integrated-circuit component comprising:

a plurality of current-generating circuits to produce, at respective outputs, a plurality of uncorrelated currents having amplitudes that increase with increasing temperature; and a load circuit coupled in common to the respective outputs of the plurality of current-generating circuits such that an aggregate of the plurality of uncorrelated currents having amplitudes that increase with increasing temperature flows therethrough to generate a reference voltage.

2. The integrated-circuit component of claim 1 wherein the load circuit comprises a resistive element through which the aggregate of the plurality of uncorrelated currents flows to produce a first voltage drop and a bipolar junction transistor, and wherein the reference voltage comprises a sum of the first voltage drop and a voltage drop across a bipolar junction transistor.

3. The integrated-circuit component of claim 2 wherein a first terminal of the resistive element is coupled in common to the respective outputs of the plurality of current-generating circuits.

4. The integrated-circuit component of claim 3 wherein a second terminal of the resistive element is coupled to the bipolar junction transistor such that the plurality of uncorrelated currents collectively flow through both the resistive element and the bipolar junction transistor.

5. The integrated-circuit component of claim 2 further a calibration circuit to adjust one or more of the uncorrelated currents to reduce a difference between a positive temperature coefficient of the first voltage drop and a negative temperature coefficient of the voltage drop across the bipolar junction transistor.

6. The integrated-circuit component of claim 2 wherein the voltage drop across the bipolar junction transistor comprises a voltage drop between an emitter terminal of the bipolar junction transistor and a base terminal of the bipolar junction transistor.

7. The integrated-circuit component of claim 1 wherein the plurality of current-generating circuits comprise respective proportional-to-absolute-temperature (PTAT) cores to produce the uncorrelated currents having amplitudes that increase with temperature.

8. The integrated-circuit component of claim 7 wherein each of the PTAT cores comprises circuitry to output a respective one of the plurality of uncorrelated currents with an amplitude that nominally matches amplitudes of currents output by others of the PTAT cores.

9. The integrated-circuit component of claim 7 wherein each of the PTAT cores comprises first and second, differently sized, bipolar junction transistors.

10. The integrated-circuit component of claim 7 wherein each of the PTAT cores comprises a resistive element having a variable resistance to enable adjustment of the respective one of the plurality of uncorrelated currents.

11. A method of operation within an integrated-circuit component, the method comprising:

outputting, via respective outputs of a plurality of current-generating circuits, a plurality of uncorrelated currents having amplitudes that increase with increasing temperature; and generating a reference voltage across a load circuit having an input coupled in common to the respective outputs of the plurality of current-generating circuits such that an aggregate of the plurality of uncorrelated currents having amplitudes that increase with increasing temperature flows through the load circuit to generate the reference voltage.

12. The method of claim 11 wherein generating the reference voltage across the load circuit comprises generating a voltage that is a sum of (i) a voltage drop across a resistive element through which the aggregate of the plurality of uncorrelated currents flows and (ii) a voltage drop across a bipolar junction transistor.

13. The method of claim 12 wherein a first terminal of the resistive element is coupled in common to the outputs of the plurality of current-generating circuits.

14. The method of claim 13 wherein a second terminal of the resistive element is coupled to the bipolar junction transistor such that the plurality of uncorrelated currents collectively flow through both the resistive element and the bipolar junction transistor.

15. The method of claim 12 further comprising adjusting one or more of the uncorrelated currents to reduce a difference between a positive temperature coefficient of the voltage drop across the resistive element and a negative temperature coefficient of the voltage drop across the bipolar junction transistor.

16. The method of claim 12 wherein the voltage drop across the bipolar junction transistor comprises a voltage drop between an emitter terminal of the bipolar junction transistor and a base terminal of the bipolar junction transistor.

17. The method of claim 11 wherein outputting, via respective outputs of the plurality of current-generating circuits, the uncorrelated currents having amplitudes that increase with temperature comprises generating the uncorrelated currents within respective proportional-to-absolute-temperature (PTAT) cores.

18. The method of claim 17 wherein each of the PTAT cores implements, at least in part, a respective one of the plurality of current-generating circuits, and outputs a respective one of the plurality of uncorrelated currents having an amplitude that nominally matches amplitudes of currents output by others of the PTAT cores.

19. The method of claim 17 wherein each of the PTAT cores comprises first and second, differently sized, bipolar junction transistors.

20. An integrated-circuit component comprising:

a plurality of means for outputting, via respective outputs thereof, a plurality of uncorrelated currents having amplitudes that increase with increasing temperature; and a load circuit coupled in common to the respective outputs of the means for outputting such that an aggregate of the plurality of uncorrelated currents having amplitudes that increase with increasing temperature flows through the load circuit to generate a reference voltage.

* * * * *